United States Patent [19]

Gordon

[11] 4,453,666

[45] Jun. 12, 1984

[54] TAMPER-EVIDENT TOP CLOSURE

[75] Inventor: Robert L. Gordon, Monroe, N.Y.

[73] Assignee: International Paper Company, New York, N.Y.

[21] Appl. No.: 374,129

[22] Filed: May 3, 1982

[51] Int. Cl.[3] ..... B65D 5/68; B65D 43/14

[52] U.S. Cl. ..... 229/43; 206/622; 229/7 R; 229/17 R

[58] Field of Search ..... 229/43, 7 R, 17 R; 206/622

[56] References Cited

U.S. PATENT DOCUMENTS

| | | | |
|---|---|---|---|
| 1,739,763 | 12/1929 | Mason . | |
| 2,146,226 | 2/1939 | Punte | 220/67 |
| 2,287,893 | 6/1942 | Lundberg | 229/17 |
| 2,308,273 | 1/1943 | Fleischer | 206/57 |
| 2,310,398 | 2/1943 | Cole | 229/43 |
| 2,354,043 | 7/1944 | Netalova et al. | 215/51 |
| 2,417,550 | 3/1947 | Guyer | 229/17 |
| 2,661,889 | 12/1953 | Phinney | 229/14 |
| 2,719,663 | 10/1955 | Jagenberg | 229/17 R |
| 3,317,068 | 5/1967 | Betner | 215/39 |
| 4,288,027 | 9/1981 | Peterson | 229/43 |

*Primary Examiner*—William Price
*Assistant Examiner*—Gary E. Elkins
*Attorney, Agent, or Firm*—Richard J. Ancel

[57] ABSTRACT

A tamper-evident top closure lid construction for a container. The lid is integrally formed from a plastic cover member, the member carrying a main and a secondary paperboard insert on its upper surface, the member and insert being bonded together. The plastic cover member has an integral tongue to define, upon tongue pivoting, an opening in the member. The main paperboard insert is hinged about a contiguous pivot axis. The secondary insert carries a pull tab. If formed from a brittle plastics material, pulling the pull tab breaks the plastics member at its tongue hinge. The pull tab is so formed as to indicate tampering to a prospective purchaser of the container provided with the top closure lid construction of this invention. The lid may also be provided with an upstanding rim to facilitate stacking.

6 Claims, 9 Drawing Figures

FIG. 4
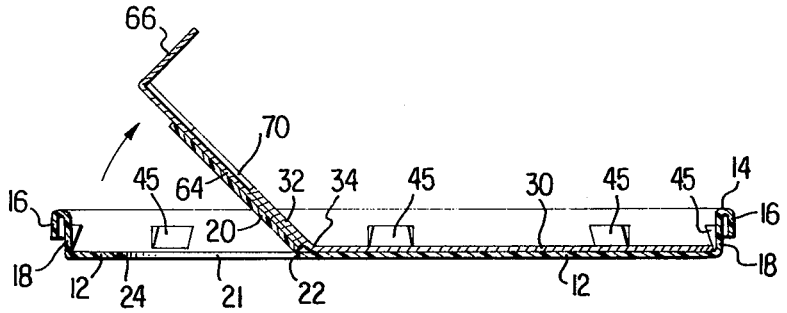
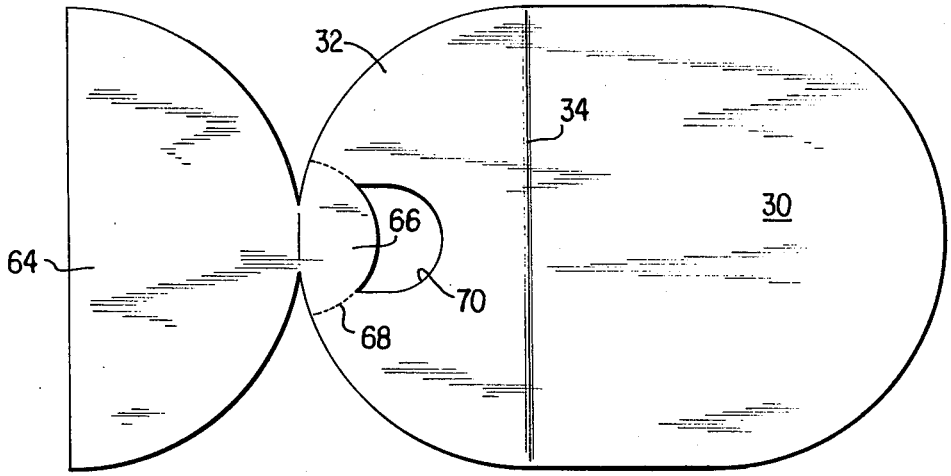
FIG. 5
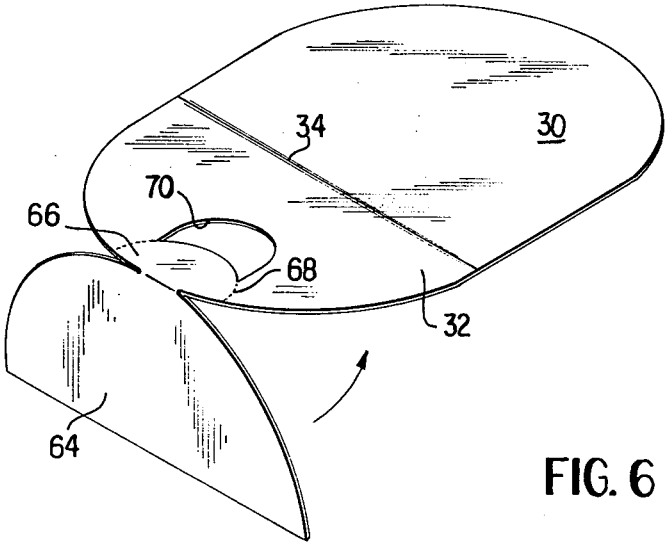
FIG. 6

FIG. 7
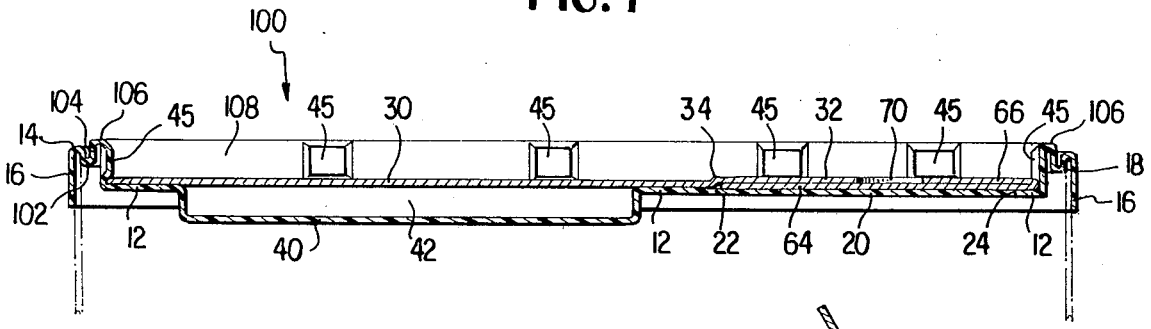
FIG. 8
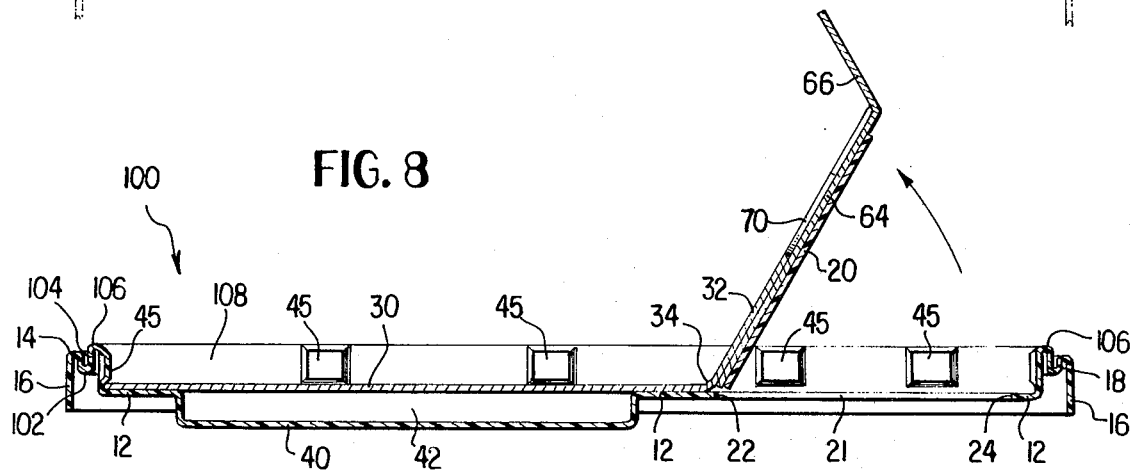
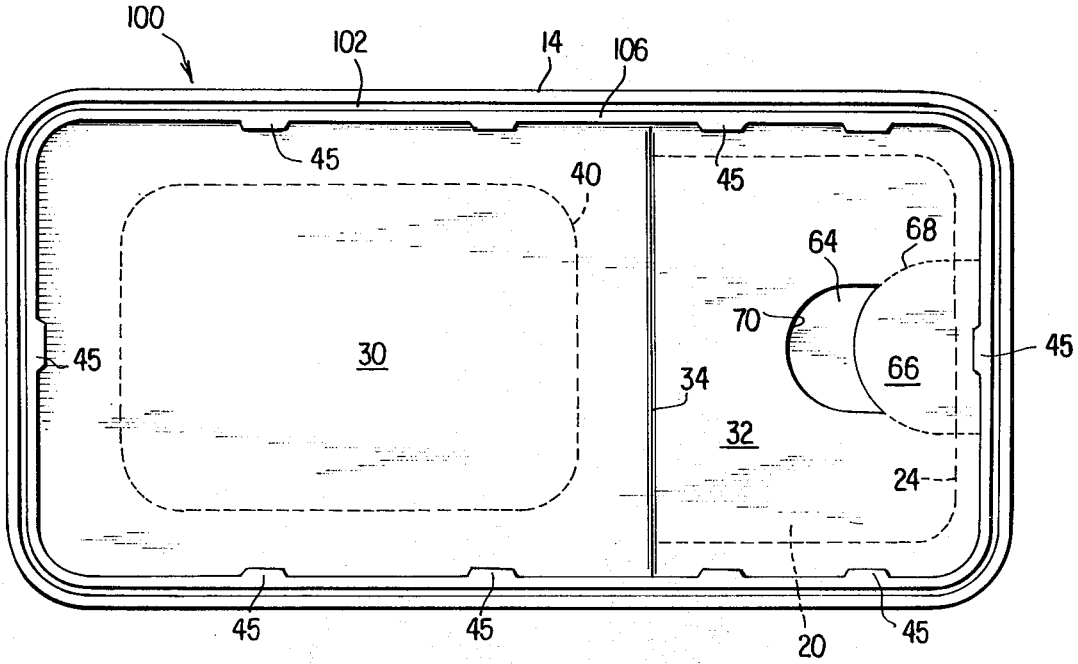
FIG. 9

TAMPER-EVIDENT TOP CLOSURE

BACKGROUND OF THE INVENTION

This invention relates to the art of containers, particularly to containers formed of paperboard or the like. The invention exhibits particular utility as a top cap closure construction for a container.

With the increasing costs of metals for lidding containers, manufacturers seek less expensive materials such as paperboard. Apart from their obvious appeal on grounds of cost and graphics, there is a need in the container art for container top closures which exhibit the property of easy opening and reclosure and which will also indicate whether the package has been tampered with. In some openable and reclosable containers, it is possible for containers to be opened and reclosed, all without any indication of such prior opening, prior to purchase by the ultimate consumer. This introduces problems of pilferage, as well as problems due to the entry of bacteria, moisture, and the like before use by the ultimate consumer.

The use of plastics materials in combination with paperboard containers has long been recognized in the container art, as for example plastic snap lids for paperboard containers. The use of plastics materials as the top closure of a container has not been entirely satisfactory in those instances wherein a reclosable opening in the container top is desired. This is because of the inherent resiliency of the plastic lid, i.e., its tendency to regain its original, closed configuration. Further, printability of plastics members is often difficult.

SUMMARY OF THE INVENTION

By the practice of this invention, a container top closure construction is formed which employs both plastics materials and paperboard and uses the best properties of each to form a novel hinge construction, particularly in the case wherein a relatively brittle plastic such as styrene is employed. Further according to the practice of this invention, a tamper-evident container top lid construction is enjoyed, thus yielding immediate apprisement to a prospective purchaser of the integrity of the container and its contents.

The full nature of the invention will be understood from the accompanying drawings and the following description and claims.

BRIEF DESCRIPTION OF THE DRAWINGS

FIG. 4 is a view similar to FIG. 1, in the open condition.

FIG. 5 is a plan view of a paperboard insert used in conjunction with the construction of FIG. 1.

FIG. 6 is a perspective view of the insert shown at FIG. 5.

FIG. 7 is a longitudinal cross-sectional view of a modification.

FIG. 8 is a view similar to FIG. 7 but showing that construction in the open position.

FIG. 9 is a top plan view of the embodiment of FIG. 7.

DETAILED DESCRIPTION OF THE INVENTION

Figure 1:
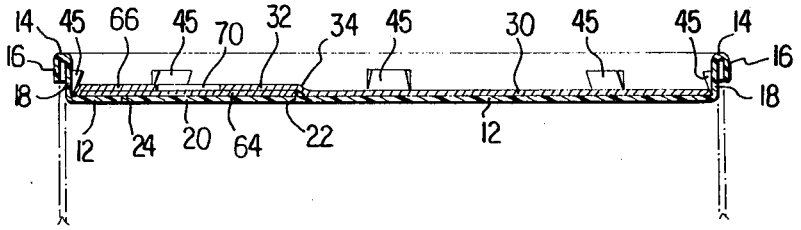
FIG. 1 is a longitudinal cross-sectional view of a top cover closure construction according to this invention.
Figure 2:
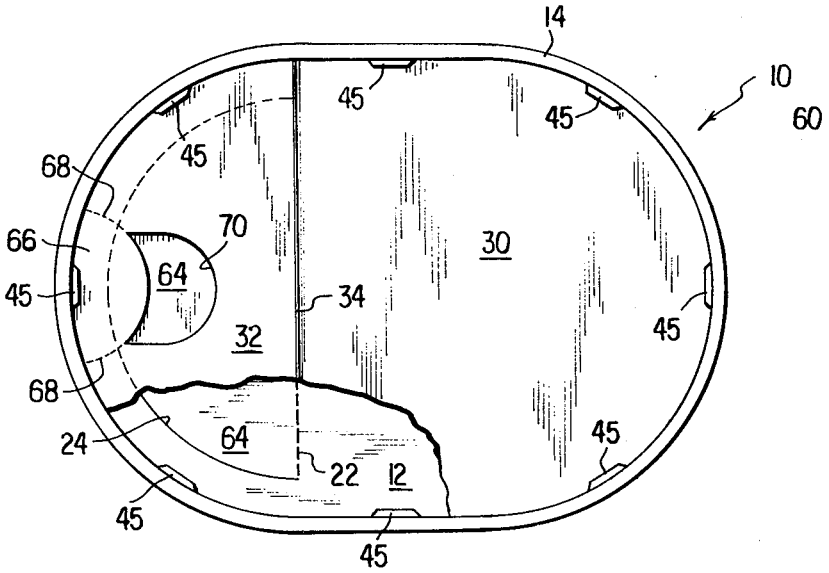
FIG. 2 is a top plan view of the construction of FIG. 1.

Referring now to FIGS. 1–6 of the drawings, the numeral 10 denotes a top closure construction according to this invention. The numeral 12 denotes an integral closure or cover member which may be formed of relatively brittle plastics material, such as styrene. The cover member 12 is provided along its outer periphery with an upstanding ridge or bight portion 14, this portion integrally joining vertically disposed wall or skirt portions 16 and 18. The numeral 20 denotes a tongue integral with cover member 12, the tongue being defined by a cut 24 extending through at least the major portion of the thickness of cover 12, and perforated line 22. Line 22 defines a pivot or hinge for tongue 20 as will be presently described.

As indicated by the dashed lines at FIG. 1, the top closure is adapted to cover and close the upper, open end of a container, the upper rim of which is sandwichingly secured between wall portions 16 and 18. The same is true of the construction of FIG. 7 (to be described later).

A main paperboard insert denoted by the numeral 30 extends across and is bonded or heat sealed or otherwise secured to at least the major portion of the top surface of cover member 12. The numeral 32 denotes an end area of the main paperboard insert 30, this end area being superposed over tongue 20 and the left hand (as viewed at FIGS. 1 and 2) portion of cover member 12 which is bounded by upstanding skirt portion 18. A hinge line 34, formed as by deformation, extends across the width of main paperboard insert 30. Hinge line 34 is preferably superposed immediately above perforated line 22 in cover member 12.

As may be seen by reference to FIGS. 5 and 6, the main paperboard insert 30 is provided with an integral, secondary paperboard insert denoted generally by the numeral 64. The number 66 denotes a pull tab, the outline of pull tab 66 defined by the perforated line 68 and a portion of opening 70 in end portion 32. FIG. 5 shows the main paperboard insert 30 and the secondary paperboard insert 64 as coplanar, with pull tab 66 also lying in this same plane. FIG. 6 shows an intermediate step in the folding of the main and secondary inserts, with secondary insert 64 being folded underneath end portion 32.

The operation is as follows. When it is desired to obtain access to the contents of the container provided with the closure cap construction illustrated, a fingernail of the user is pushed down into opening 70 of end area 32 and underneath the already formed portion of pull tab 66. Pull tab 66 is now pulled upwardly, thereby ripping it free from the remainder of end area 32 along perforation lines 68. After these perforations have been completely severed, the pull tab is no longer connected to end portion 32, its sole connection being at its base to secondary paperboard insert 64. The upper surface of paperboard insert 64 is bonded to the lower surface of end portion 32. Continued upward pulling of pull tab 66 causes upward pivoting of end area 32 about hinge line 34. The lower surface of secondary paperboard insert 64 is bonded or heat sealed or otherwise secured to the top surface of tongue 20, so that such upward pulling results in a pivoting of tongue 20 about its hinge line 22. This defines an opening 21 in cover member 12 through which the contents of the container, the top portion of which is indicated by the dashed lines at FIG. 1, may be dispensed.

Figure 3:
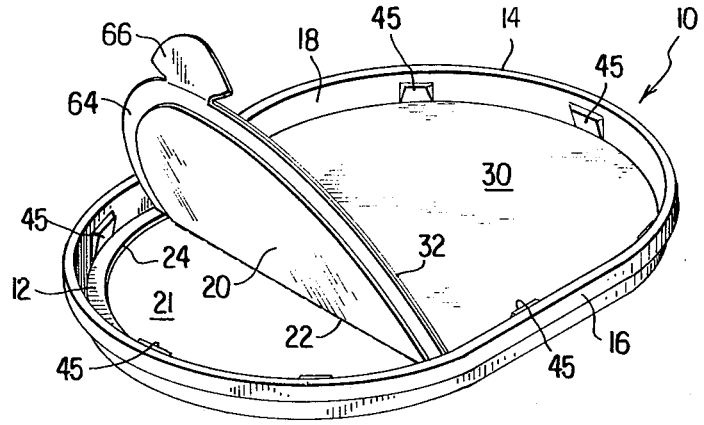
FIG. 3 is a perspective view of the construction shown at FIG. 1 in the open condition.

Detents 45 may be placed immediately forwardly of the end area 32 so as to assist in maintaining the now open lid portion 32 in the position illustrated at FIG. 3. Both sides of the main and secondary paperboard inserts 30 and 64 may be coated with a thermoplastic material, both for protection of the product against moisture and for purposes of adhesion under the application of heat and pressure (using known techniques).

For reclosure, the end area 32 is pushed downwardly, past the resistant forces of closing detents 45, until tongue 20 resumes its original position. Detents 45 are inwardly tapered, from their uppermost to their lowermost portions. These detents may also be placed around the inner circumference of wall 18 to assist in maintaining insert 30 in place.

The reader will observe that the ripping away of tab 66 from its original, coplanar position with end portion 32 of main paperboard insert 30 will indicate, to a prospective purchaser of the container, whether there has been any prior tampering with the container.

The specific configuration of the main and secondary paperboard inserts is itself known in the prior art. For example, U.S. Pat. Nos. 2,354,043 and 1,739,763 disclose similar constructions. However, these constructions are not in the same combination.

Referring now to FIGS. 7–9, another form of the invention is illustrated. In these Figures, the numeral 100 denotes a modified top closure lid construction which includes many of the same elements previously described. Thus, the construction includes vertically extending peripheral wall portions 16 and 18 which are adapted to receive the open end of a filled container, as indicated by the dashed lines at FIG. 7. Additionally, the top closure lid is provided with a radially inwardly positioned bight portion 102 commencing at the bottom of wall portion 18 and communicating with vertically extending wall portion 104, in turn terminating in an upper bight portion 106 to which is connected yet another vertically extending wall portion 108, the latter merging with the generally flat portion of plastics cover member 12.

This second form also includes the main and secondary paperboard inserts 30 and 64 of the embodiment of FIGS. 1–6, although here rectangular in form, and also includes a coupon or promotional materials well 42 defined by depressed wall portion 40 of cover member 12 and the main paperboard insert 30. Additionally, this second embodiment employs an upstanding portion defined by bight portion 106 and vertically extending walls 104 and 108 to define a stacking ridge around the container. Thus, bight portion 106 is adapted to fit into either a complementary recess or within a complementary recess in the bottom of a container stacked thereupon. The embodiment of FIGS. 7–9 exhibits the features of the previously described embodiment, with the additional feature of facilitating stacking of containers provided with the shown top construction.

Again, a pair of (opposite) detents 45 assists in maintaining lid portion 32, 64, 20 in the up position of FIG. 8. Detents 45 may be placed around the radially innermost surface of wall 108 to assist in maintaining insert 32 in place.

The tongue 20 may substantially separate from the remainder of the member 12, as shown in FIG. 8, or it may remain with member 12 as shown in FIG. 4. If the cover member 12 is formed from a relatively brittle or rigid material such as styrene, the paperboard insert 30 will support tongue 20 after it has effectively been broken off from main plastics member 12. In this connection, it should be pointed out that if support tongue 20 is rotated 90 degrees when opened by the ultimate consumer, it will result in the breaking or splitting of the brittle hinge line 22. This, in turn, prevents the tongue 20 from resiliently bending back to obstruct opening 21 when the container contents are being dispensed.

The container that is used in connection with the top closure lid construction 10 described herein generally comprises a body portion made from a five-layer construction consisting of (from the outside in): polyethylene (P.E.)/paperboard (solid bleached sulfate)/P.E./foil/P.E. Other laminate constructions can be utilized if necessary. For example, another such construction consists of P.E./paperboard/P.E. Yet another laminate construction, having medium barrier properties, consists of P.E./paperboard/P.E./P.E. The P.E. may very in thickness from 0.5 to 1.5 mil, and it may comprise either low or high density P.E., or combinations thereof. Moreover, other plastics such as Surlyn, polypropylene, and the like may be substituted for, or used in conjunction with, P.E., depending upon the final barrier properties required. The paperboard layer may vary in thickness between 12 and 25 mils, and the aluminum foil is generally 0.00035 inches thick. It will be obvious that a laminate construction can be designed to meet varying barrier requirements. The bottom of the container is generally made from the same material as the side walls. In general, the plastic top closure construction 10 will be manufactured from a plastics material having a thickness varying between 15 and 30 mils, depending upon the strength and barrier requirements of the product packaged within the container. It will also be recognized that the containers may be manufactured in various shapes, i.e., round, oval, oblong, or "rectangular" with rounded corners. Since the body of the container is manufactured from a blank, no extra labeling is required since the blanks can be pre-printed.

Generally speaking, the present invention relates to a top closure lid construction for a container. The lid is integrally formed from a plastic cover member, the member carrying a main and a secondary paperboard insert on its upper surface, the member and insert being bonded together. The plastics member has an integral tongue to define, upon tongue pivoting, an opening in the member. The main paperboard insert is hinged about a contiguous pivot axis. The secondary insert carries a pull tab. If formed from a brittle plastics material, pulling the pull tab breaks the plastics member at its tongue hinge. The pull tab is so formed as to indicate tampering to a prospective purchaser of the container provided with the top closure lid construction of this invention. This lid may also be provided with an upstanding rim to facilitate stacking. It will also be observed that the top cover construction of this invention, by virtue of the use of paperboard, lends itself to ease of printing, graphics, and the like.

Although the present invention has been described above by reference to preferred embodiments, it will be appreciated that other constructions may be devised, which are, nevertheless, within the scope and spirit of the invention and are defined by the claims appended hereto.

What is claimed is:

1. In a top closure lid construction for a container, the lid being formed of:

(a) a cover member formed of a relatively low brittle plastics materials, the cover member having means along its periphery for sealing attachment to the upper open end portion of a container, the cover member having a tongue formed integrally therefrom, the tongue partially defined by a weakened hinge-forming line to serve as a hinge for the tongue, the remainder of the tongue defined by a curved cut line extending through the thickness of the cover member, the ends of the cut line terminating, respectively, at the ends of the weakened hinge-forming line, whereby when the tongue is pivoted upwardly about its hinge forming line, a dispensing opening is defined in the cover member; and (b) a main paperboard insert superposed on and bonded to the top surface of the cover member and having an end area overlying said tongue, the main paperboard insert having a fold line forming a deformation line overlying and substantially aligned with the weakened hinge-forming line of the cover member, the said end area of the main paperboard insert having a pull tab connected thereto, whereby when the pull tab is pulled upwardly, both the cover member tongue and the overlying end area of the main paperboard insert pivot about their respective hinges and fold lines to thereby define an opening in the cover member and the cover member tongue is at least partially broken off from the remainder of the cover member and the tongue is thereafter carried by the end area of the main paperboard insert to thereby preclude blocking of the dispensing opening during dispensing by the inherent resiliency of the plastics cover member material from which the tongue is formed, the improvement comprising means to render said top closure lid construction tamper-evident, said means comprising a secondary paperboard insert, said secondary insert carrying a pull tab and positioned between the main paperboard insert and the brittle plastics cover member and extending from an edge of the main paperboard insert to said fold line defining the deformation line, the secondary insert being initially connected by a perforated line to the end area of said main paperboard insert and initially bonded to at least the tongue portion of the cover member, whereby when the pull tab is pulled to thereby pivot the tongue and define an opening in the cover member, the pull tab will separate from said end area of said main paperboard insert along said perforated line, but will remain connected to the edge of said secondary paperboard insert, whereby the first use of the pull tab to pivot the tongue will be evident.

2. The tamper-evident, top closure lid construction of claim 1 wherein said brittle plastics material forming said cover member is styrene.

3. The tamper-evident top closure lid construction of claim 1 including means for initially maintaining the pull tab in a horizontal position against the top surface of said secondary paperboard insert.

4. The tamper-evident top closure lid construction of claim 1 wherein said main and secondary paperboard inserts are integrally joined to each other.

5. The tamper-evident top closure lid contruction of claim 4 wherein at least a portion of said pull tab is coplanar with the main paperboard insert.

6. The tamper-evident top closure lid construction of claim 5 wherein the main paperboard insert is provided with an opening contiguous to a peripheral portion of the pull tab, whereby a fingernail recess is defined to assist in grasping the tab.

* * * * *